US007665617B2

(12) United States Patent
Shea

(10) Patent No.: US 7,665,617 B2
(45) Date of Patent: Feb. 23, 2010

(54) MERCHANDISING DISPLAY ASSEMBLY

(75) Inventor: Thomas M. Shea, Troy, MI (US)

(73) Assignee: T.M. Shea Products, Inc., Troy, MI (US)

( * ) Notice: Subject to any disclaimer, the term of this patent is extended or adjusted under 35 U.S.C. 154(b) by 562 days.

(21) Appl. No.: 11/156,293

(22) Filed: Jun. 17, 2005

(65) Prior Publication Data

US 2006/0283818 A1 Dec. 21, 2006

(51) Int. Cl.
*A47F 5/08* (2006.01)

(52) U.S. Cl. ..... 211/59.1; 211/85.28; 211/54.1; 211/128.1; 211/55; 211/57.1; 40/617; 40/124.06; 40/607.02; 40/752

(58) Field of Classification Search ..... 211/59.1, 211/85.28, 86.01, 54.1, 57.1, 55, 128.1; 40/617, 40/606.19, 606.01, 607.01, 537, 124.2, 654.01, 40/607.02, 124.06, 752
See application file for complete search history.

(56) References Cited

U.S. PATENT DOCUMENTS 1,033,915 A * 7/1912 Mcdonald ..... 402/68
1,997,829 A * 4/1935 Mckee ..... 211/55
2,291,966 A * 8/1942 Joseph ..... 248/215
2,532,600 A * 12/1950 Broersma ..... 211/55
3,285,424 A * 11/1966 Emery ..... 211/55
4,607,753 A * 8/1986 Radek ..... 211/94.01
5,038,946 A * 8/1991 Tenser et al. ..... 211/168
5,085,325 A * 2/1992 Jones et al. ..... 209/580
5,085,328 A * 2/1992 Evenson ..... 211/55
5,109,993 A * 5/1992 Hutchison ..... 211/87.01
D359,230 S * 6/1995 Levine ..... D8/395
5,887,731 A * 3/1999 Thalenfeld ..... 211/57.1
6,050,426 A * 4/2000 Leurdijk ..... 211/94.01
6,234,436 B1 * 5/2001 Kump ..... 248/220.21
6,286,690 B1 * 9/2001 Thalenfeld ..... 211/113
6,612,057 B2 * 9/2003 Shoemaker et al. ..... 40/607.02
6,772,890 B2 * 8/2004 Campbell et al. ..... 211/94.01

* cited by examiner

*Primary Examiner*—Katherine W Mitchell
(74) *Attorney, Agent, or Firm*—Harness, Dickey & Pierce, P.L.C.

(57) ABSTRACT

A merchandising display assembly. The assembly includes a mounting portion adjustably coupled to a support surface associated with a first product, and a suspending portion for suspending a second product. The suspending portion coupled to the mounting portion, and the mounting and suspending portions are adapted for at least reducing interference with the visibility of the first product.

24 Claims, 3 Drawing Sheets

MERCHANDISING DISPLAY ASSEMBLY

INTRODUCTION

Today's self-service retail industry demands efficient display of various products while minimizing floor space requirements. The merchandise display capacity of a self-service retail store is inherently limited by the store's square footage of interior space. In this regard, the amount of area available within a store directly limits the number of products which may be effectively displayed for sale. Heretofore, various merchandising display devices have been employed to increase the merchandising display capacity of a store. Some of the devices commonly used to increase a store's merchandising capacity include gondola display units and various other self-standing "point of sale" displays.

For certain types of merchandise, such as greeting cards, for example, a relatively large surface area is required to properly display and showcase the products. In such cases, the problem of displaying related goods near the original products without obstructing the original products, using additional space or impeding traffic flow, can become particularly acute. For a greeting card display unit, for example, it may be advantageous to display together with the greeting cards other related items, such as, ribbons, stickers or other small decorative items, theme-related gift items, gift tags, gift wrap, adhesive tape, and other package materials, without obscuring the visibility of the greeting cards.

Although the existing merchandising display units can be satisfactory for their intended purposes, there is still a need for merchandising display assemblies and methods that increase sales of additional products related to original products by increasing the visibility of the related products near the original products, while maintain visibility of the original products and without using valuable shelf or floor space.

SUMMARY

The present teachings provide a merchandising display assembly. The merchandising display assembly includes a mounting portion adjustably coupled to a support surface associated with a first product, and a suspending portion for suspending a second product. The suspending portion is coupled to the mounting portion, and the mounting and suspending portions are adapted for at least reducing interference with the visibility of the first product.

The present teachings also provide for a merchandising display assembly that includes a plate member adjustably engaging a support surface of a display unit for displaying a plurality of first products, and an elongated member coupled to the plate member and including an engagement feature for suspending at least a second product, wherein the elongated member is adapted for suspending the second product at a position that does not significantly interfere with the visibility of the first products.

The present teachings provide a method for displaying at least one additional product in front of a display unit having pockets for receiving originally displayed products. The method includes inserting a plate member of a display assembly in one of the pockets, and suspending the additional product from an elongated member coupled to the plate member without substantially interfering with the visibility of the originally displayed products.

Further areas of applicability of the present invention will become apparent from the detailed description provided hereinafter. It should be understood that the detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description is merely exemplary in nature and is in no way intended to limit the invention, its application, or uses. For example, although the present teachings are illustrated for use in connection with displays of greeting cards, the present teachings can also be used in connection with other display units, such as, for example, displays of periodicals, office supplies or other products.

Figure 1:
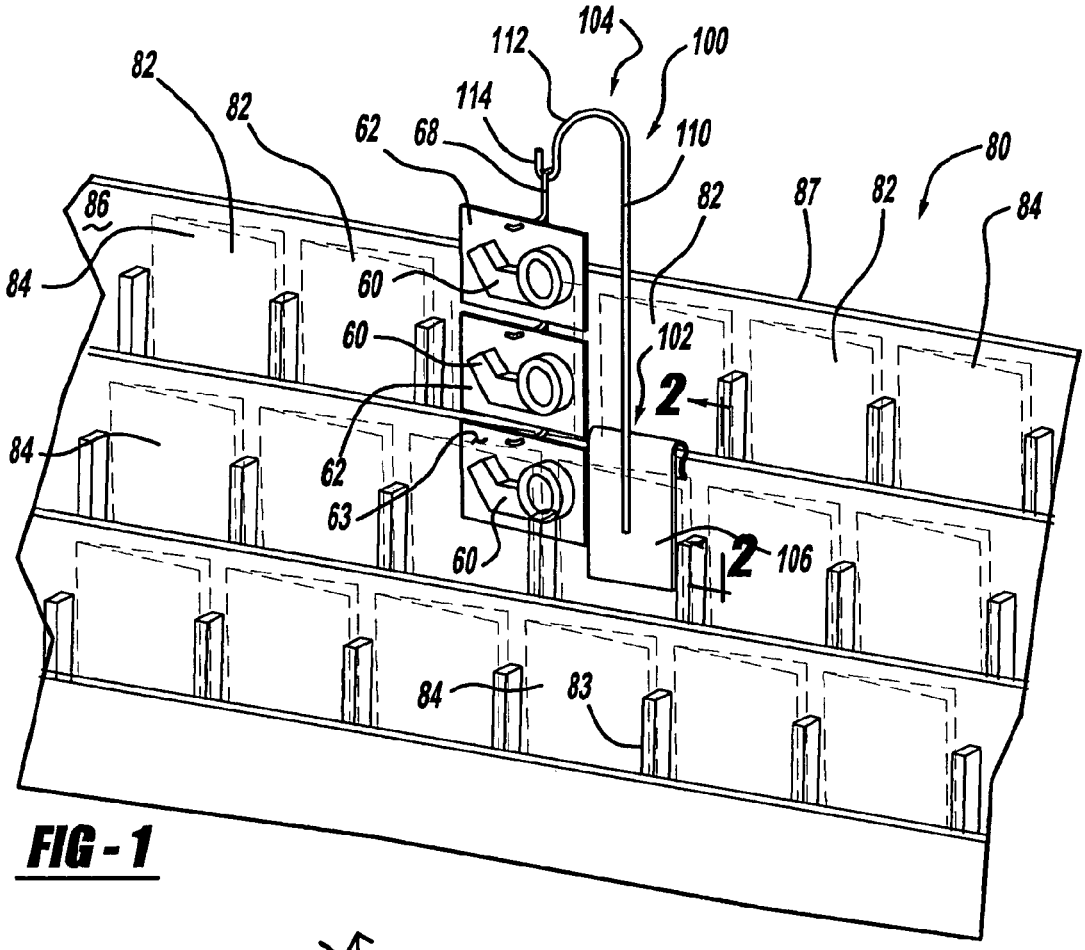
FIG. 1 is a perspective view of an exemplary merchandising display assembly according to the present teachings, the assembly shown coupled to a display unit for greeting cards.
Figure 2:
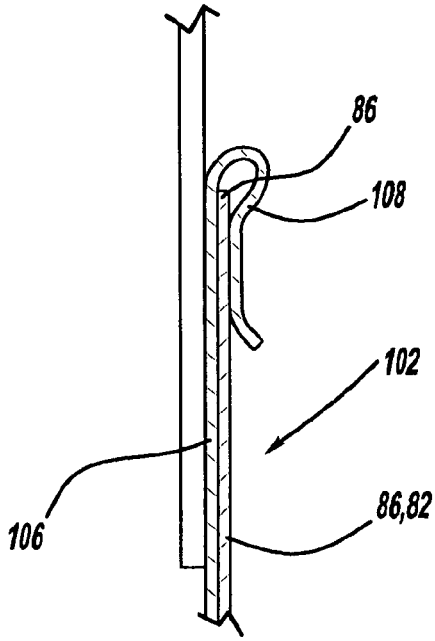
FIG. 2 is sectional view of the merchandising display assembly of FIG. 1 taken along axis 2-2.

Referring to FIG. 1, an exemplary merchandising display assembly 100 according to the present teachings is illustrated in connection with a display unit 80. The display unit 80 can include pockets 82 that can hold originally displayed (original) products 84, such as, for example, greeting cards, magazines, paper products, office supplies, or other products. The pockets 82 can be arranged, for example, in rows and columns. The merchandising display assembly 100 is illustrated for displaying additional products 60 freely or with individual or multiple product holders 62. The products 60 can be associated with the original products 84 for point-of-purchase advantage, can be additional products of the same type as the original products, or can be unrelated products. When the original products 84 are, for example, greeting cards, the additional products 60 can be associated gift-wrapping, packaging or shipping items, such as gift wrap kits, tags, ribbons, stickers, adhesive tape, small decorative or ornamental items, theme/content related items or other related products. For birthday cards, for example, the theme-related items can be name tags, balloons, birthday stones, zodiac stickers, candy, gum, pins, flowers, and other gift items for birthdays. It will be understood by these skilled in the art that the subject invention is not limited to the particular additional products 60 suspended for point-of-purchase display.

The pockets 82 that receive the original products 84 can be plastic pockets, slots or other holders that can be individually defined on a divider or other support surface 86 of the display unit 80. The pockets 82 can also be defined by small spacers, such as plastic tabs or other structures 83 that delineate a space for each original product 84, or stacks thereof. In some applications, the support surface 86 can be a wire grid or frame that defines pockets 82. Instead of a wire frame, other types of frames can also be used, such as plastic or wooden frames or dividers. Similarly, the display unit 80 can be a wall unit, or a free-standing unit, such as gondola, carousel, pole, or any other suitable display unit 80.

Referring to FIGS. 1-5, the merchandising display assembly 100 can include a mounting portion 102 and a suspending portion 104. The mounting portion 102 can include a plate member 106 dimensioned to be received in one of the pockets 82 and/or abut against the support surface 86. The plate member 106 can include an extension 108 that bends over to define a clip, hook, clamp or other engagement feature that can removably engage an edge or edge portion 87 of the support surface 86 or of the pocket 82, when the pocket 82 has individual support surface 86.

The merchandising display assembly 100 can also include a suspending portion 104 coupled to the mounting portion 102. The suspending portion 104 can include an elongated member 110, such as a rod or bar, an arm 112 and an engagement feature 114 for supporting additional products 60 or product holders 62 for additional products 60. The elongated member 110, the arm 112 and the engagement feature 114 can be constructed as one integral component, or can be modularly assembled, or can be permanently interconnected. When constructed as an integral component, the suspending portion 104 can be formed as a metal bar or rod which is bent to the appropriate shape, or can be molded as a single piece of plastic or composite material. The arm 112 can include a curved portion adapted for extending a desired distance "D" in a direction perpendicular to the plane of the plate member 106 for providing product clearance and visibility. Similarly, the height "H" of the furthest point of the arm 112 above the extension 108 or above the top of the plate member 106 can be selected for enhancing visibility of the additional products 60, and at least reducing interference with the visibility of the original products 84.

The elongated member 110 can be welded or spot welded to the plate member 106, when those members are metallic. The elongated member 110 and the plate member 106 can alternatively be coupled by other known devices and methods depending on the materials used. The elongated member 110 can also be removably connected to the plate member 106 using screws or other fasteners. The elongated member 110 can also be adjustably coupled to the plate member 106 for adjusting the height H of the suspending portion 104. The elongated member 110 can be, for example, slidably received in a slot or tubular portion defined by the plate member 106. The height H and the distance D can be adapted for suspending the additional product or products 60 with or without product holders 62 at a position that does not significantly interfere with the visibility of the original products 84. The elongated member 110 can also be completely removable from the plate member 106 to facilitate, for example, shipping and/or storing the merchandising display assembly 100.

Figure 3:
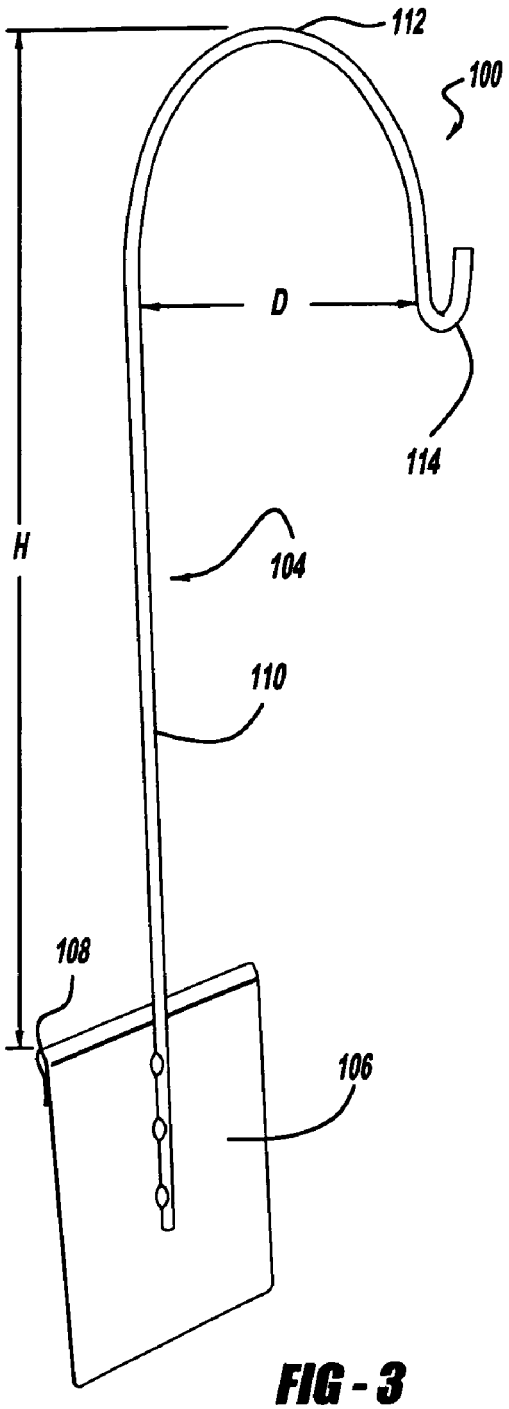
FIG. 3 is a perspective view of an exemplary merchandising display assembly according to the present teachings.
Figure 4:
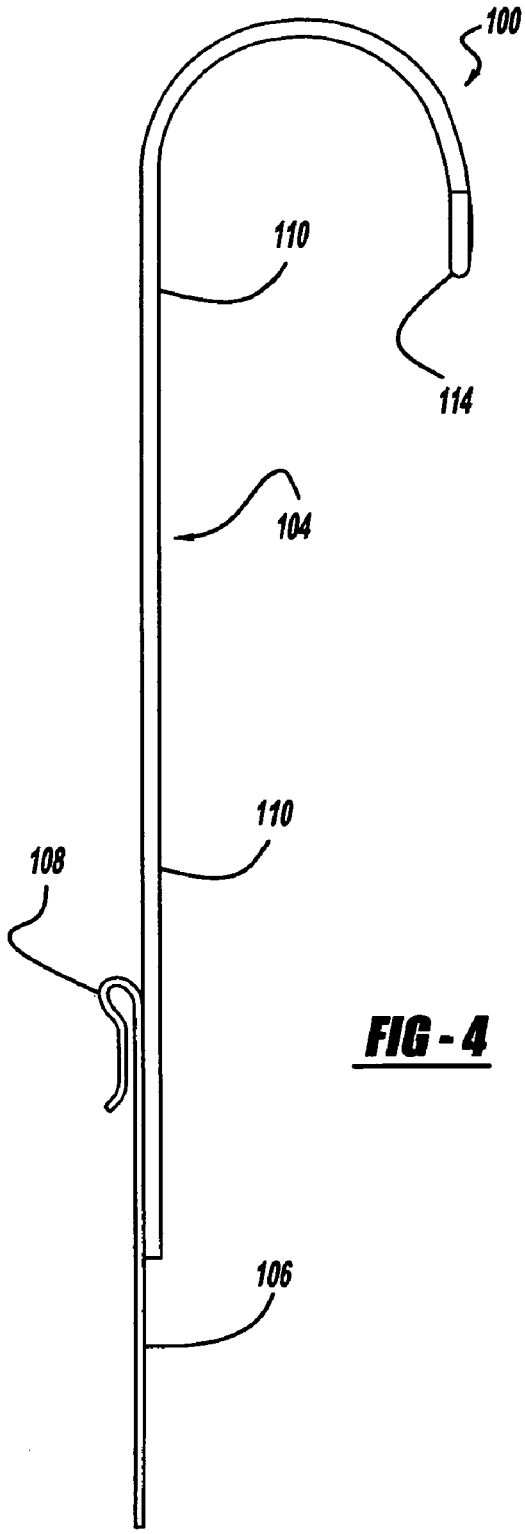
FIG. 4 is an elevated side view of the merchandising display assembly of FIG. 3.
Figure 5:
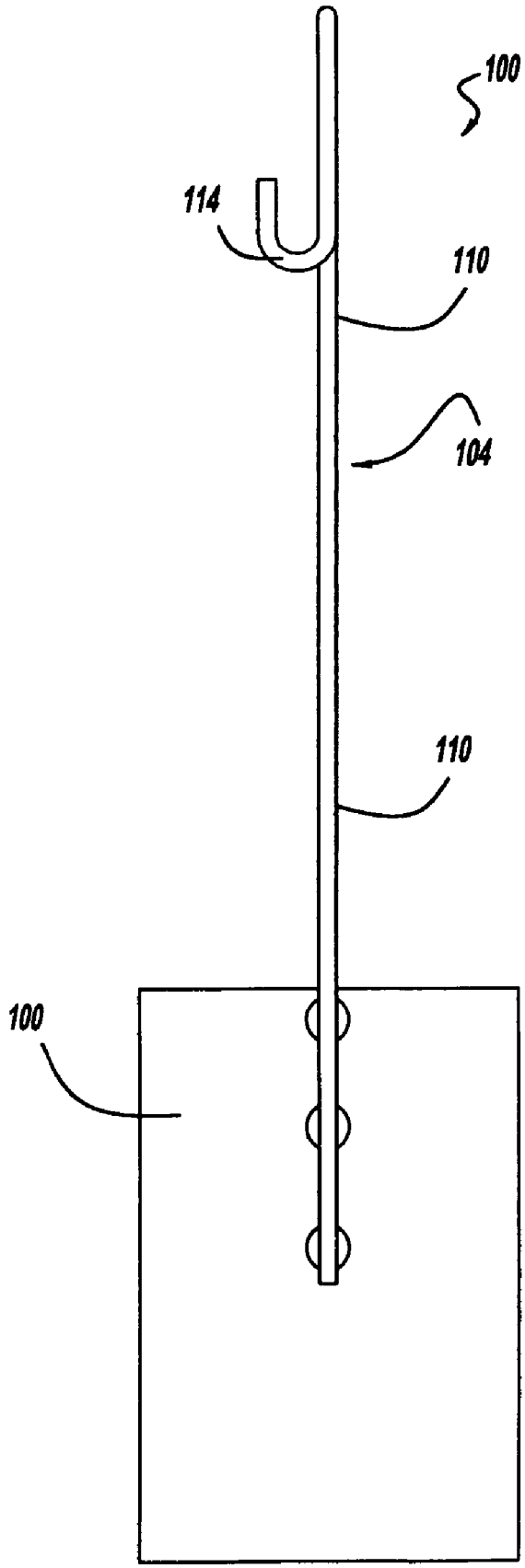
FIG. 5 is a front view of the merchandising display assembly of FIG. 3.

Referring particularly to FIGS. 3-5, the engagement feature 114 of the plate member 106 can define a hook, clip, clamp or other engagement device, and can be oriented such that the product 60 or the product holder 62 can hang at an orientation that is orthogonal, or parallel, or skewed at any desired angle relative to the plate member 106 or to the support surface 86 of the display unit 80. In the exemplary illustration of FIGS. 3-5, the engagement feature 114 defines a planar hook oriented in a direction parallel to the plate member 106. Accordingly, products 60 or product holders 62 that define a substantially planar surface 63 can be directly suspended from the engagement feature 114 such that the planar surface 63 is orthogonal to the plate member 106, thereby not significantly interfering with the visibility of original products 84. It will be appreciated that separate hooks or other hanging devices 68 can be used to modify the angle of the product 60 relative to the display unit 80.

From the forgoing discussion it will be appreciated that the merchandising display assembly 100 can create additional display space featuring additional products 60 for various types of existing display units 80, while retaining sufficient consumer visibility of the original products 84 on the display unit 80 and without impeding traffic flow in the vicinity of the display unit 80.

The merchandising display assembly 100 can increase product sales by displaying additional products 60, related or unrelated to the original products 84, without decreasing visibility, accessibility, or focus for the original products 84.

The merchandising display assembly 100 can be removably and/or adjustably coupled to the display unit 80, such that seasonal or promotional demands or needs can be accommodated. For example, several units of the merchandising display assembly 100 can be added during holidays to support various holiday ornaments or other holiday related items in front of holiday greeting cards and then removed after the holiday season is over. The merchandising display units 100 can also be moved from one location to another to feature different products appropriate for the season. For example, a merchandising display assembly 100 can be moved from a birthday area to a graduation area of a greeting card display during graduation season.

The foregoing discussion discloses and describes merely exemplary arrangements of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A merchandising display assembly for a display unit with a pocket in which a first retail product is displayed, the pocket including a support surface, the merchandising display assembly comprising:

a mounting portion that is removably supported by the support surface, the mounting portion including a top end;

an elongated member that is fixedly coupled to the mounting portion;

an arm that is coupled to the elongated member, the arm including a point that is furthest from the top end of the mounting portion, the elongated member supporting the arm in midair such that the point of the arm is spaced vertically upward from the top end of the mounting portion; and an engagement feature for supporting a second retail product in midair, the engagement feature being coupled to the arm such that the arm is disposed between the elongated member and the engagement feature, the engagement feature being spaced horizontally outward from the elongated member such that a vertical space and a horizontal space are defined between the second retail product and the mounting portion in a manner to at least reduce interference with the visibility of the first product.

2. The merchandising display assembly of claim 1, wherein the mounting portion removably engages a wall of the pocket.

3. The merchandising display assembly of claim 2, wherein the mounting portion includes a plate member at least partially received in the pocket.

4. The merchandising display assembly of claim 3, wherein the plate member includes an extension rolling over an edge of the pocket.

5. The merchandising display assembly of claim 4, wherein the extension includes a clamp.

6. The merchandising display assembly of claim 2, wherein the mounting portion includes a plate member, and wherein the elongated member is fixedly coupled to the plate member.

7. The merchandising display assembly of claim 6, wherein the arm includes a curved portion extending over and away from the support surface for the first retail product.

8. The merchandising display assembly of claim 7, wherein the engagement feature is for suspending the second product at an angle relative to the plate member.

9. The merchandising display assembly of claim 8, wherein the engagement feature defines a planar hook parallel to the plate member.

10. The merchandising display assembly of claim 2, wherein the pocket is a greeting card pocket.

11. The merchandising display assembly of claim 1, in combination with the display unit with the pocket.

12. The merchandising display assembly of claim 1, in combination with the display unit with the pocket.

13. The merchandising display assembly of claim 1, wherein the arm is substantially U-shaped so as to extend in both a vertically upward direction generally away from the mounting portion and a vertically downward direction generally toward the mounting portion.

14. The merchandising display assembly of claim 1, wherein the elongated member, the arm, and the engagement feature are integrally attached so as to be monolithic.

15. A merchandising display assembly for a display unit on which a first retail product is displayed, the display unit including a support surface, the merchandising display assembly comprising:

a plate member adjustably engaging the support surface, the plate member including a top end; and an elongated member fixedly coupled to the plate member;

an arm that is coupled to the elongated member, the arm including a point that is furthest from the top end of the plate member, the elongated member supporting the arm in midair such that the point of the arm is spaced vertically upward from the top end of the plate member; and an engagement feature for supporting a second retail product in midair, the engagement feature being coupled to the arm such that the arm is disposed between the elongated member and the engagement feature, the engagement feature being spaced horizontally outward from the elongated member such that a vertical space and a horizontal space are defined between the second retail product and the plate member in a manner to at least reduce interference with the visibility of the first product.

16. The merchandising display assembly of claim 15, wherein the plate member is adapted to be received in a pocket holding at least one of the first retail products.

17. The merchandising display assembly of claim 15, wherein the plate member defines an extension engaging an edge of one of the support surface or the pocket.

18. The merchandising display assembly of claim 15, wherein the engagement feature is planar and oriented at an angle to the plate member.

19. The merchandising display assembly of claim 15, wherein the engagement feature is a planar hook parallel to the plate member.

20. The merchandising display assembly of claim 15, wherein the arm is substantially U-shaped so as to extend in both a vertically upward direction generally away from the plate member and a vertically downward direction generally toward the plate member.

21. The merchandising display assembly of claim 15, wherein the elongated member, the arm, and the engagement feature are integrally attached so as to be monolithic.

22. A method for displaying at least one additional product in front of a display unit having pockets for receiving originally displayed products, the method comprising:

inserting a plate member of a display assembly in one of the pockets, the display assembly including an elongated member that is fixedly coupled to the plate member, an arm that is coupled to the elongated member, and an engagement feature that is coupled to the arm such that the arm is disposed between the elongated member and the engagement feature;

supporting in midair the arm and the engagement feature with the elongated member such that a point of the arm is furthest from a top end of the plate member, such that the point of the arm is spaced vertically upward from the top end of the plate member, and such that the engagement feature is spaced horizontally outward from the elongated member; and suspending the additional product from the engagement feature without substantially interfering with the visibility of the originally displayed products.

23. The method of claim 22, further comprising suspending the additional product at an angle of about 90 degrees relative to the plate member.

24. A merchandising display arrangement for retail display of a first retail product and a second retail product, the arrangement comprising:

a display unit with a pocket in which the first retail product is displayed, the pocket including a support surface; and a merchandising display assembly for displaying the second retail product, the merchandising display assembly including a mounting portion and a supporting member, the mounting portion removably supported by the support surface, the supporting member being monolithic and having a coupling portion that abuts and is fixedly coupled to the mounting portion, the supporting member also having an extending portion that extends longitudinally beyond a top end of the mounting portion, the extending portion extending in a generally vertical direction upward from the mounting portion and extending in a generally horizontal direction outward from the mounting portion, the supporting member including an engagement feature for supporting a second retail product in midair and spaced vertically upward and horizontally outward from the mounting portion, wherein a vertical distance is defined between the top end of the mounting portion and a furthest point on the extending portion away from the top end of the mounting portion, wherein a horizontal distance is defined between the engagement feature and the mounting portion, and wherein the vertical distance is greater than the horizontal distance.

* * * * *